US005204522A

United States Patent [19]

Takahashi et al.

[11] Patent Number: 5,204,522

[45] Date of Patent: Apr. 20, 1993

[54] METHOD FOR DRIVING A PHOTOELECTRIC DEVICE AND A METHOD FOR DRIVING AN IMAGE INTENSIFIER USING THE PHOTOCATHODE DEVICE

[75] Inventors: Akira Takahashi; Mitsunori Nishizawa, both of Hamamatsu, Japan

[73] Assignee: Hamamatsu Photonics K.K., Hamamtsu, Japan

[21] Appl. No.: 694,783

[22] Filed: May 2, 1991

[30] Foreign Application Priority Data

May 8, 1990 [JP] Japan ..... 2-117905

[51] Int. Cl.[5] ..... H01J 31/50

[52] U.S. Cl. ..... 250/214 VT; 250/214 AG

[58] Field of Search ..... 250/213 VT, 214 AG; 313/529, 526, 537

[56] References Cited

U.S. PATENT DOCUMENTS

| | | | |
|---|---|---|---|
| 4,603,250 | 7/1986 | Contini et al. | 250/213 VT |
| 5,095,202 | 3/1992 | Watase et al. | 250/213 VT |
| 5,146,077 | 9/1992 | Caserta et al. | 250/213 VT |

FOREIGN PATENT DOCUMENTS

| | | |
|---|---|---|
| 91304142 | 11/1991 | European Pat. Off. . |
| 61-215401 | 9/1986 | Japan . |
| WO90/00307 | 6/1989 | Netherlands . |
| 2183083 | 5/1987 | United Kingdom . |

OTHER PUBLICATIONS

Y. Tsuchiya et al., "Universal Streak Camera", A Reprint of the Proceedings from the 16th International Congress on High Speed Photography and Photonics, Aug., 1984, *SPIE High Speed Photography*, vol. 491, pp. 86–94.

H. Nakamura et al., "Image Intensifier with Nanosecond Shutter Function", ITEJ Technical Report, Nov., 1987, vol. 11, No. 28, pp. 31–36.

A. Lundy et al., "Ultrafast Gating of Proximity Focused Microchannel-plate Intensifiers", *SPIE High Speed Photography*, vol. 348, (1982) pp. 178–189.

IEEE Transactions on Nuclear Science, vol. NS-25, No. 1 Feb. '78, Lundy et al "Avalanche Transistor Pulser for Fast-Gated Operation of Microchannel Plate Image-Intensifiers" pp. 591–597.

IEEE Transactions on Nuclear Science, vol. NS-30, No. 6 Dec. 1983, Jacoby et al "Direct Cating of Microchannel Plates" pp. 4624–4627.

*Primary Examiner*—David C. Nelms
*Assistant Examiner*—T. Davenport
*Attorney, Agent, or Firm*—Beveridge, DeGrandi, Weilacher & Young

[57] ABSTRACT

There is disclosed a method for driving a photoelectric device comprising a photocathode, and controller for controlling electrons emitted from the photocathode, wherein gate voltages are applied respectively to the photocathode and the controller so that the electrons from the photocathode are not outputted from the controller.

4 Claims, 11 Drawing Sheets

METHOD FOR DRIVING A PHOTOELECTRIC DEVICE AND A METHOD FOR DRIVING AN IMAGE INTENSIFIER USING THE PHOTOCATHODE DEVICE

BACKGROUND OF THE INVENTION

1. Field of Industrial Uses

This invention relates to a method for driving a photoelectric device, especially a two-dimensional photoelectric device, and to a method for driving an image intensifier (II) using the photoelectric device.

The image intensifier intensifies the contract of an image of an extremely small quantity of light. This invention relates to a method for driving a proximity-type image intensifier comprising a two-dimensional photoelectric device comprising a photocathode in the side of the electron input electrode of a microchannel plate (MCP) for multiplying electrons, and a phosphor screen arranged in the side of the electron output electrode of the MCP.

2. Related Background Art

It has been conventionally proposed to give the proximity-type image intensifier the high-speed shuttering function (gating function). To this end, in the most common driving method a gate is closed by constantly applying a positive voltage between the photocathode and the input electrode of the MCP and, by applying a negative pulse voltage (acceleration voltage) at a required timing, the gate is opened during the time. In a one-step advanced driving method, for the purpose of varying the gate opening time (shutter opening time) negative voltages having a time lag with respect to each other are applied respectively to the photocathode and the input electrode of the MCP (Technical Report, The Institute of Television Technology, Vol. 11, No. 28, pp 31–36 (Nov. 1987)).

But the former driving method has problems that ringings and iris effect take place.

That is, it is difficult that the usual photocathode matches the driving impedance of an acceleration negative pulse voltage applied thereto. As a result, ringings take place in the negative pulse voltage. FIG. 1(S) shows the ringings of the negative pulse voltage. The gain between the photocathode and the input electrode of the MCP is substantially linear with respect to an applied voltage to the photocathode. As a result, the ringings of the negative pulse voltage directly affect the intensity of the output radiation from the phosphor screen. That is, as shown in the waveforms a, b of the output radiation intensity of FIG. 1(B), the gate is adversely opened by the ringings of the negative pulse voltage.

In addition, the usual photocathode has high surface resistance, and consequently, even when a voltage having a sharp rise, such as a negative pulse voltage, is applied, the voltage does not immediately arrive up to the center of the photocathode due to its RC time constant. As a result, the gate has "iris effect", which opens the gate from the outer circumference of the photocathode radially inward toward the center thereof. The iris effect restricts a substantial minimum gate opening time, specifically, at present, up to around 3 ns.

In the latter method, in which different negative voltages which are delayed in timing from each other are applied to the photocathode and the input electrode of the MCP, compared with the former method the ringing is less affective, but the iris effect still takes place.

To prevent the iris effect, a metal is vaporized on the photocathode to lower the surface resistance. But in this case, the transmittance of the photocathode is lowered, and a new problem of poor sensitivity occurs.

These problems exit also in the two-dimensional photoelectric device comprising a proximity-type image intensifier having the phosphor screen omitted.

SUMMARY OF THE INVENTION

An object of this invention is to provide a method for driving a proximity-type image intensifier and a method for driving a two-dimensional photoelectric device.

To attain this object, a driving method according to this invention comprises applying gate voltages respectively to a photocathode and control means, such as a MCP, so that electrons emitted from the photocathode are not outputted from the control means.

A driving method according to this invention comprises opening the gate of the MCP by a first negative pulse voltage, and opening the gate of the photocathode by a second negative pulse voltage, whereby only while the both gates are opened, the gate as a proximity-type image intensifier or a two-dimensional photoelectric device is opened. Ringings and the iris effect take place in the gate of the photocathode as do in the prior art methods. In the MCP, however, its gain longarithmically changes with respect to an applied voltage, and, as a result, neither ringings nor the iris effect takes place in the MCP gate of the photocathode as do in the prior art methods. In the MCP, however, its gain logarithmically changes with respect to an applied voltage, and, as a result, neither ringings nor the iris effect takes place in the MCP gate. Besides, its gate opening time is a fraction of a pulse width of an applied negative pulse voltage. Consequently, neither ringings nor the iris effect takes place in the gate as the two-dimensional photoelectric device or the proximity-type image intensifier, which is an overlap of both gates, and its gate opening time is very small.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

Figure 1:
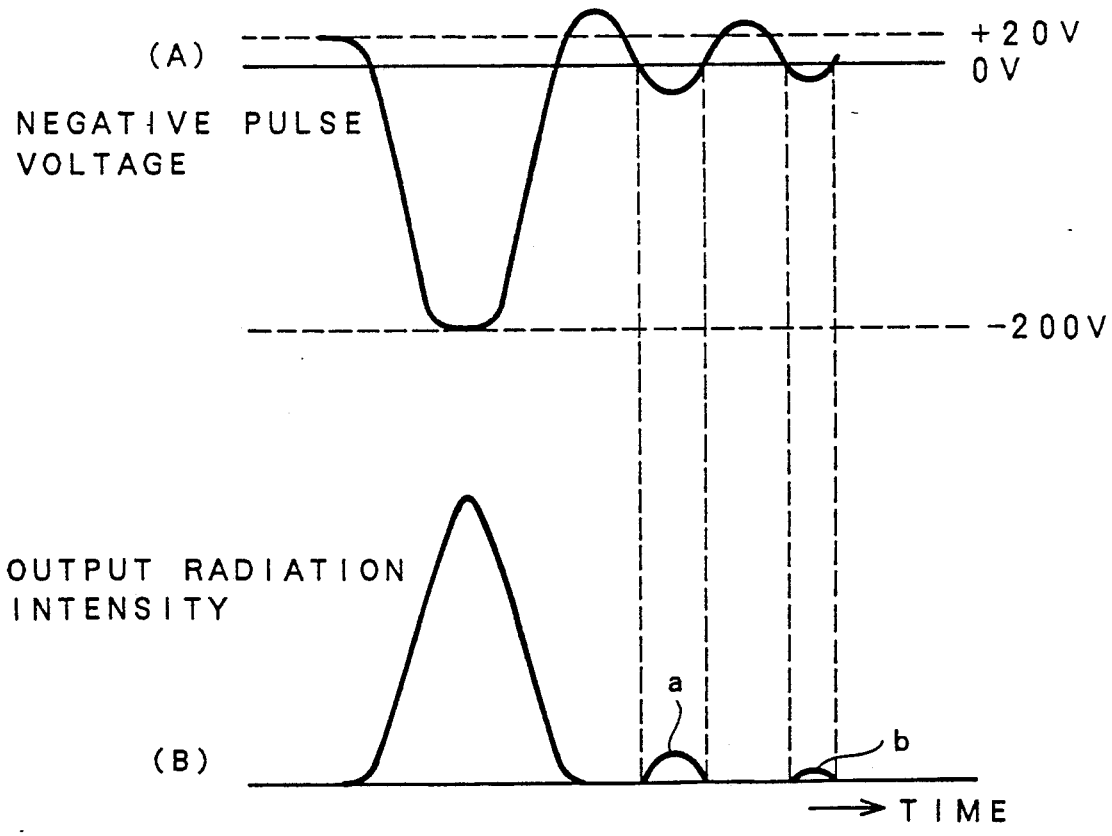
FIG. 1 shows ringing influence of the negative pulse in the conventional device.
Figure 2:
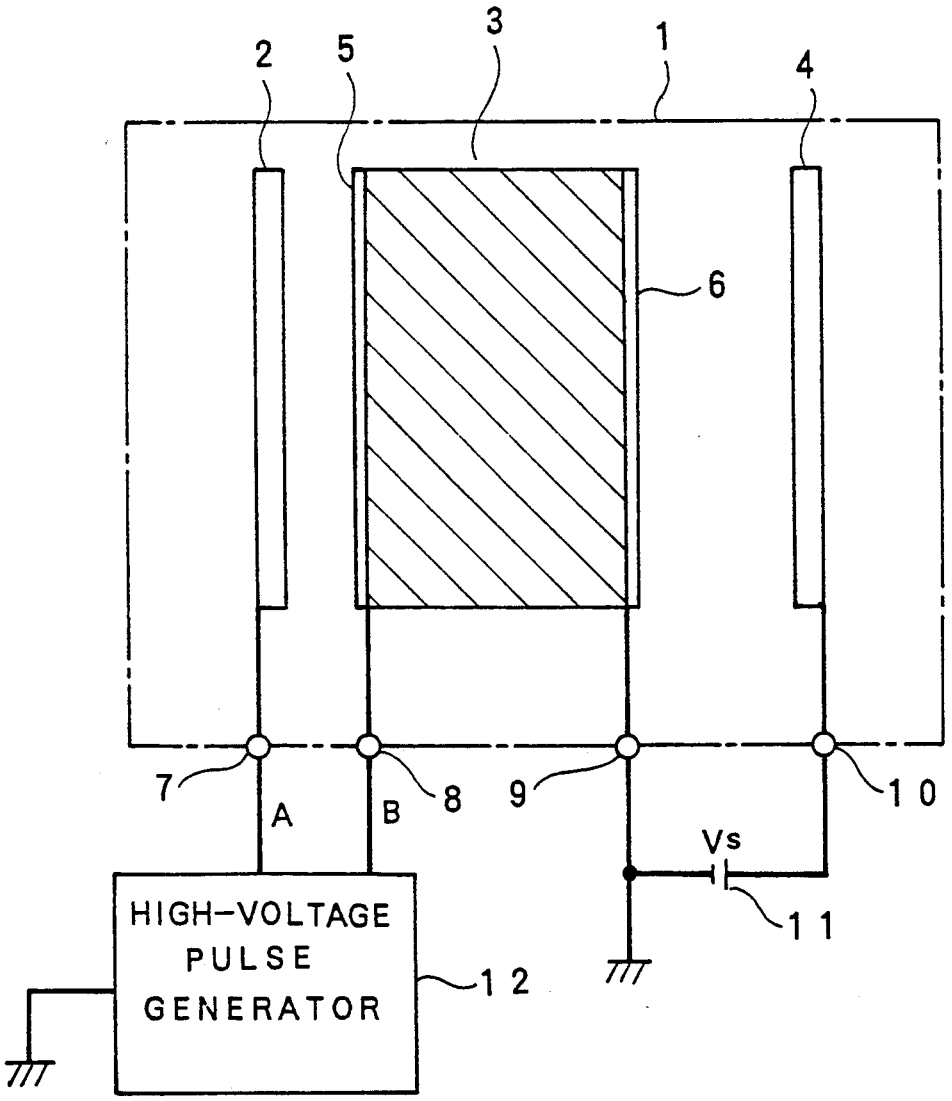
FIG. 2 shows a block diagram of one embodiment of a proximity-type image intensifier according to the present invention.
Figure 3:
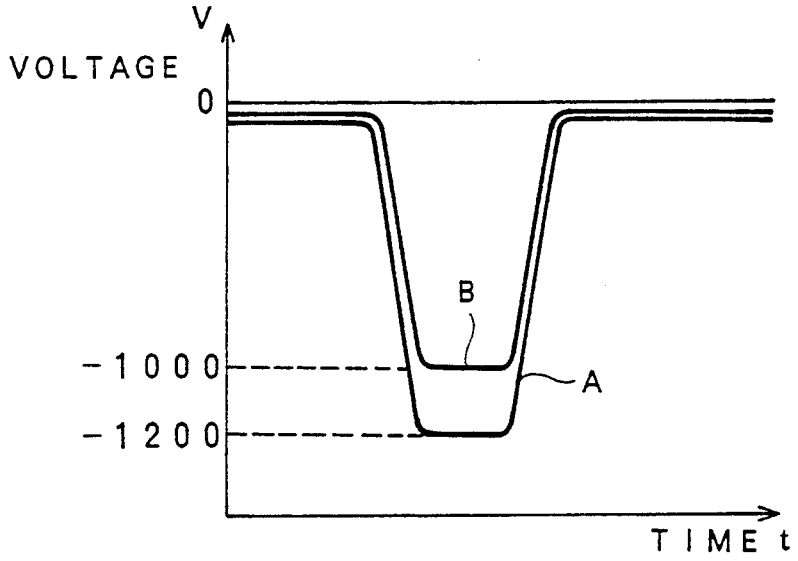
FIG. 3 shows a waveform of negative pulse voltage to be applied to a photocathode and an electron input electrode of the device shown in FIG. 2.

FIG. 2 is a block diagram of one embodiment of a proximity-type image intensifier this invention is applied to, and its peripheral circuits. A proximity-type image intensifier 1 comprises a photocathode 2 for converting incident radiation into electrons, a microchannel plate (MCP) 3 for multiplying the electrons from the photocathode 2, and a phosphor screen 4 for converting the electrons from the MCP 3 into visible radiation. The electron output electrode 6 of the MCP 3 is grounded by way of a terminal 9. A positive direct current voltage $V_s$ is applied to the phosphor screen 4 through a terminal 10. Negative pulse voltages A, B shown in FIG. 3 are applied to the photocathode 2, and an electron input electrode 5 of the MCP 3 at a required timing by a high-voltage pulse generator 12 respectively by way of a terminal 7 and a terminal 8. As the positive direct current voltage $V_s$, 5000 V, for example, is applied, as the negative pulse voltage A, −1200 V, for example, is applied, and as the negative pulse voltage B, −1000 V, for example, is applied.

Figure 4:
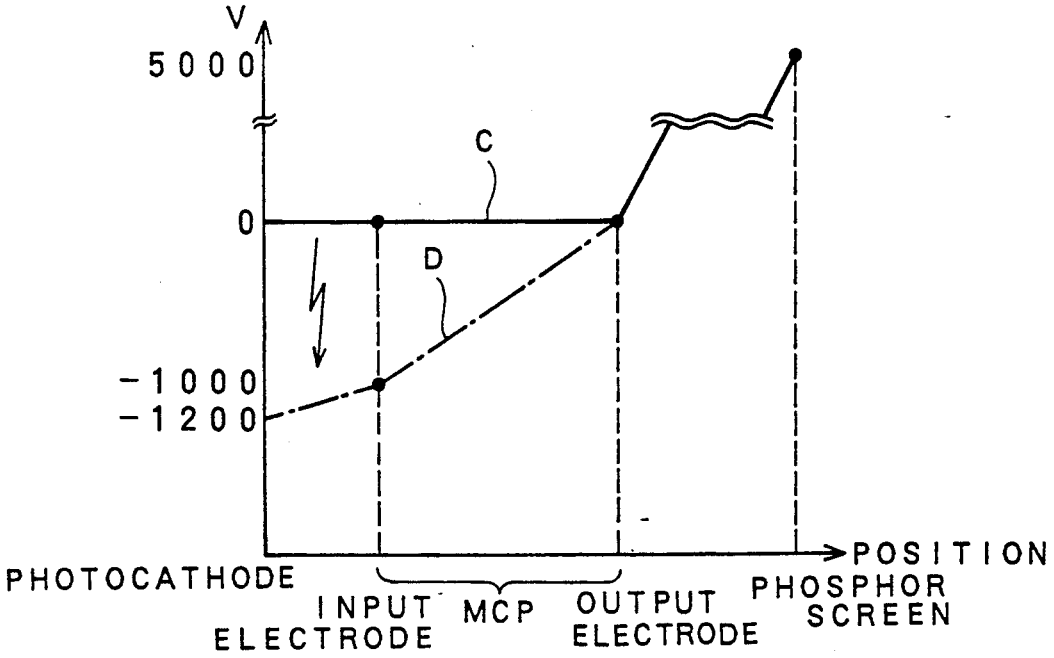
FIG. 4 shows potential changes at respective positions in the device shown in of FIG. 2 due to the negative pulse voltages A, B of FIG. 3.

FIG. 4 shows potential changes at respective positions in the proximity-type image intensifier 1 due to the negative pulse voltage A, B. When the negative pulse voltages A, B are not applied, the voltage between the photocathode 2 and the electron input electrode 5, and that of the MCP 3 are zero as indicated by the solid line C, and electrons emitted from the photocathode 2 do not reach the electron input electrode 5. This is, the gate of the proximity-type image intensifier 1 is closed. In this state, when the negative pulse voltages A, B are applied substantially simultaneously, the potential in the proximity-type image intensifier 1 changes to the state indicated by the one-dot chain line D in FIG. 5. That is, an acceleration voltage −200 V (−1200 V−(−1000 V)) is applied between the photocathode 2 and the electron input electrode 5, and a voltage−1000 V for electron multiplying is applied to the MCP 3. Electrons generated by weak radiation incident on the photocathode 2 are accelerated to be incident on the electron input electrode 5 of the MCP 3, multiplied by the MCP 3, accelerated further by the direct current voltage $V_s$ to be incident on the phosphor screen 4, and are outputted in an image having the contrast intensified. That is, the gate is opened.

Next it will be explained that this embodiment makes it possible to open the gate for a very short period of time as short as around 1 ns.

Figure 5:
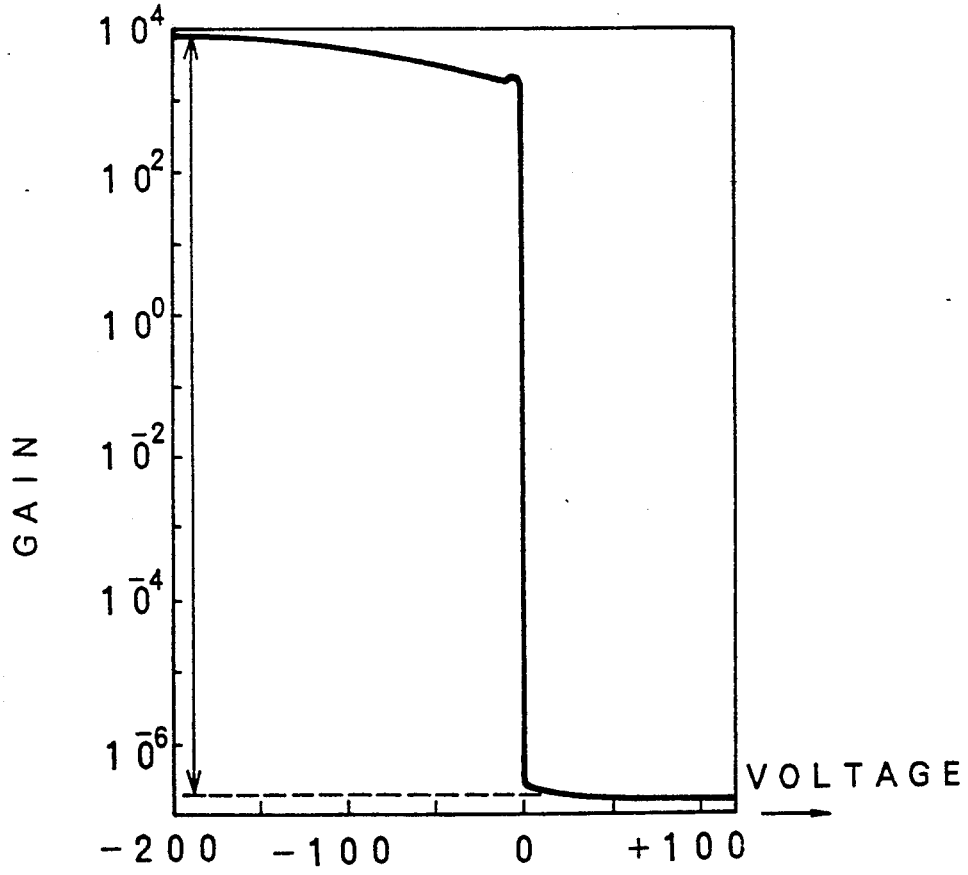
FIG. 5 shows the gain characteristics between a photocathode 2 and an electron input electrode 5 in the device shown in FIG. 2.
Figure 6:
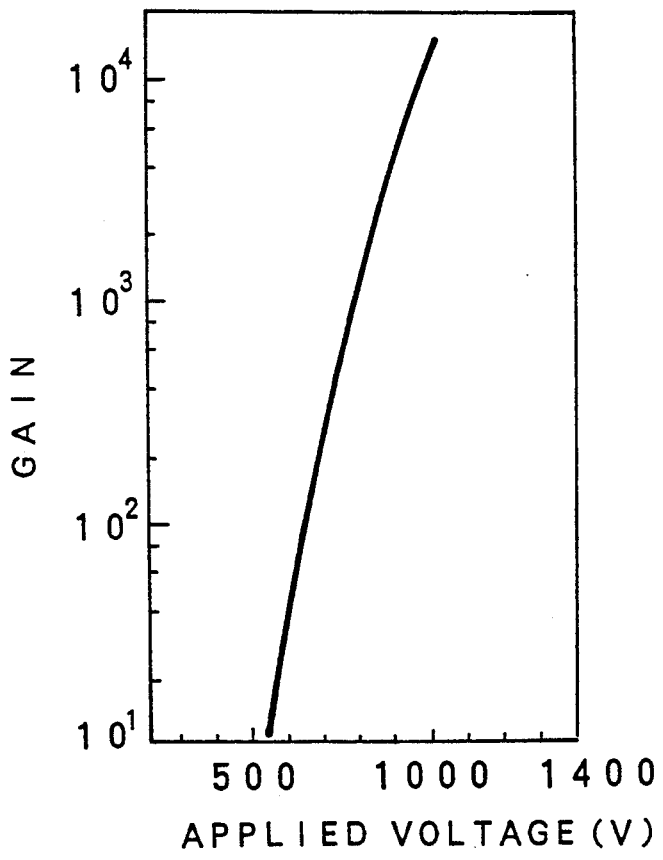
FIG. 6 shows the gain characteristics of a Micro-Channel Plate 3 of the device shown in FIG. 2.

FIG. 5 shows the gain characteristic between the photocathode 2 and the electron input electrode 5. As shown in FIG. 5, the gain depicts a curve immediately rising at a 0 V-applied voltage and saturated around −200 V. FIG. 6 shows the gain characteristic of the MCP 3. As shown in FIG. 6, the gain of the MCP 3 logarithmically rises with respect to the applied voltage.

Figure 7:
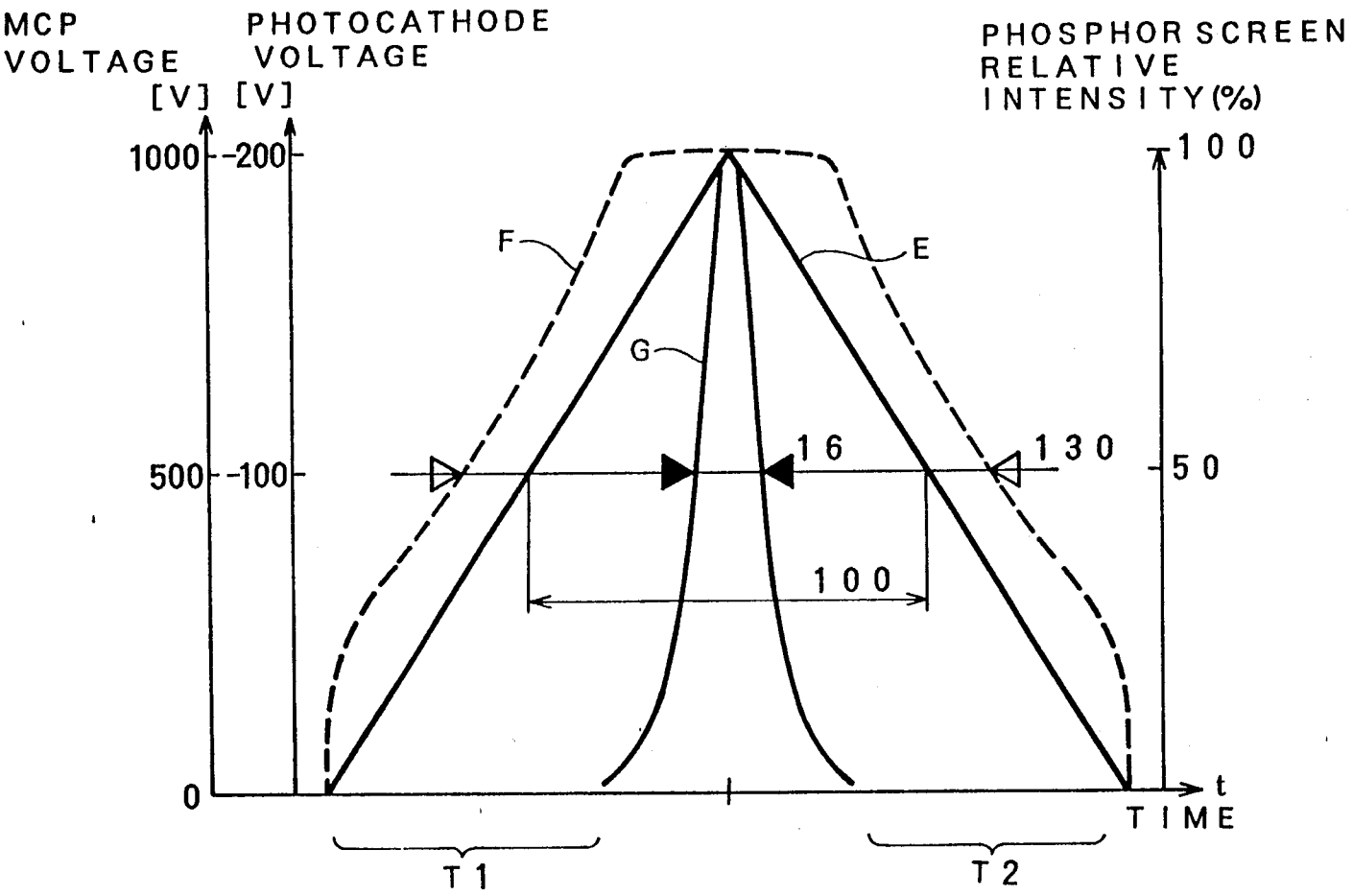
FIG. 7 shows the gate characteristics of one embodiment shown in FIG. 2.

Based on these gain characteristics, FIG. 7 shows the gain characteristic of the case where pulses having the same form are applied between the photocathode 2 and the electron input electrode 5 (photocathode gate), and between the electron input electrode 5 and the electron output electrode 6 thereof (MCP gate). In FIG. 7, E, F and G represent respectively the applied voltages, the photocathode gate characteristic, and the MCP gate characteristic. The applied voltage E is a triangle wave as shown in FIG. 7. When the half width of the triangle wave is 100, the gate width of the photocathode gate is expanded to 130. But that of the MCP gate is as small as 16, which is due to that, as described above, the gain of the MCP 3 rises logarithmically with respect to the applied voltage. As a result, the total gain characteristic has the same waveform as the MCP gain characteristic G. That is, the influence of the iris effect is eliminated from the rise time $T_1$ and the fall time $T_2$, and the gating time can be very short (around 1ns).

Figure 8:
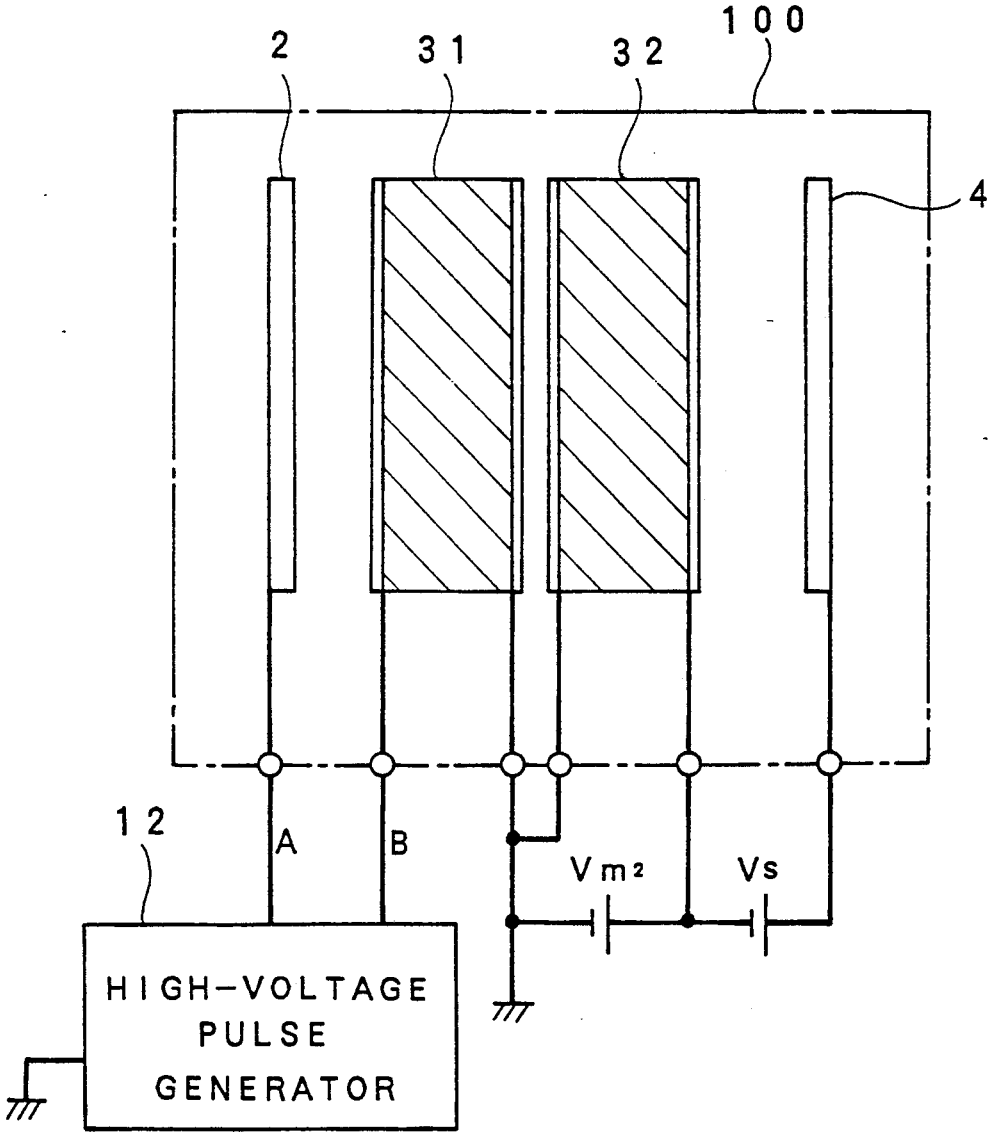
FIG. 8 shows a block diagram of the modification of the embodiment.

FIG. 8 shows a proximity-type image intensifier 100 having two MCPs 31, 32. The same driving method as that applied to the proximity-type image intensifier 1 of FIG. 2 is also applicable to the proximity-type image intensifier 100.

Figure 9:
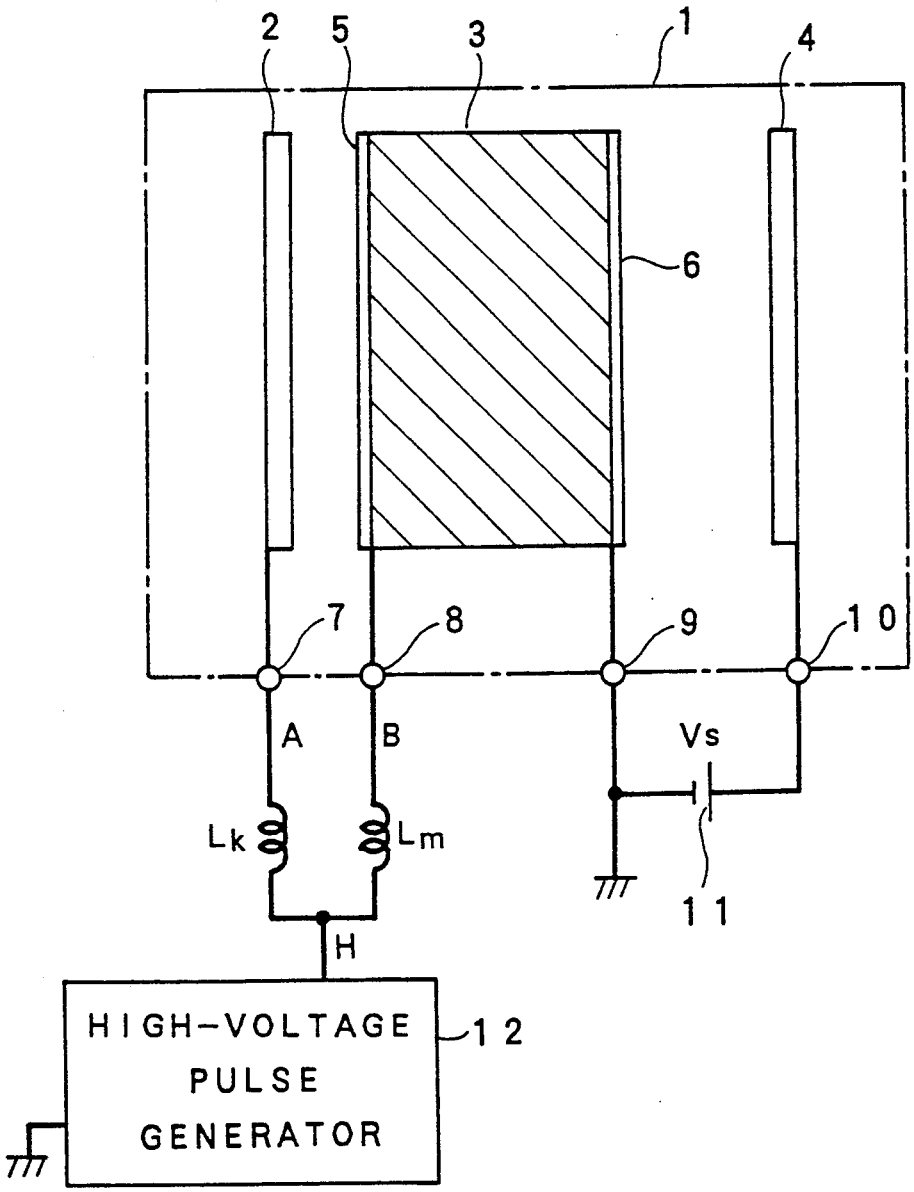
FIG. 9 shows a block diagram of an another embodiment according to the present invention.

FIG. 9 shows another embodiment of this invention. In this embodiment, an inductance $L_k$ is connected to the terminal 7 of a photocathode 2, and an inductance $L_m$ is connected to the terminal 8 of the electron input electrode 5 of a MCP 3, and a common negative pulse voltage H is applied to the other ends of the inductances $L_k$, $L_m$. When the negative pulse voltage H is applied, the inductances $L_k$, $L_m$ cause negative pulse voltages having different amplitudes from each other between the terminals 7, 8. A difference between these amplitudes becomes an acceleration voltage between the photocathode 2 and the electron input electrode 5. The inductances $L_k$, $L_m$ are actually as high (some 10 nH) as to be substituted by inductances of lead wires.

Figure 10:
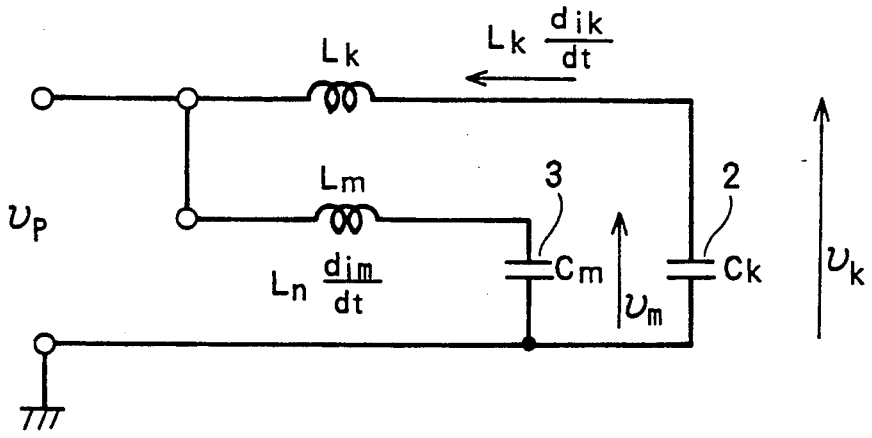
FIG. 10 shows an equivalent circuit of the embodiment shown in FIG. 9.

The functions of the inductances $L_k$, $L_m$ will be explained by the equivalent circuit of FIG. 10. In FIG. 10, capacities $C_k$, $C_m$ are those of the photocathode 2 and the MCP 3. The relationship holds.

$$v_p(=\text{negative pulse voltage } H) = L_k\frac{di_k}{dt} + v_k = L_m\frac{di_m}{dt} + v_m$$

capacity $C_m$. For one example, a common proximity-type image intensifier was actually measured.

$C_k$=23.3 pF $C_m$=77.1 pF

When the negative pulse voltage H ($=v_p$) is applied, naturally a current flows to the larger capacity, i.e., the MCP 3. When $L_k=L_m$, an actual voltage applied to the MCP 3 is lower than an actual voltage applied to the photocathode 2 due to a potential fall of $$L_m\frac{di_m}{dt}$$

According to the inventors' actual measurement, when the inductances $L_k$, $L_m$=54 nH, and a rise time of a voltage was 0.5 ns, and the peak of the negative pulse voltage H was $-1.8$ $k_v$, the actually applied photocathode voltage and MCP voltage were respectively $-1.5$ $k_v$ and 800 V.

In this embodiment the applied negative pulse voltage is one, and the high-voltage pulse generator 12 may have a simple circuit.

It is possible that the applied voltages to the photocathode 2 and the MCP 3 can be set at required values by changing the inductances $L_k$, $L_m$.

Figure 11:
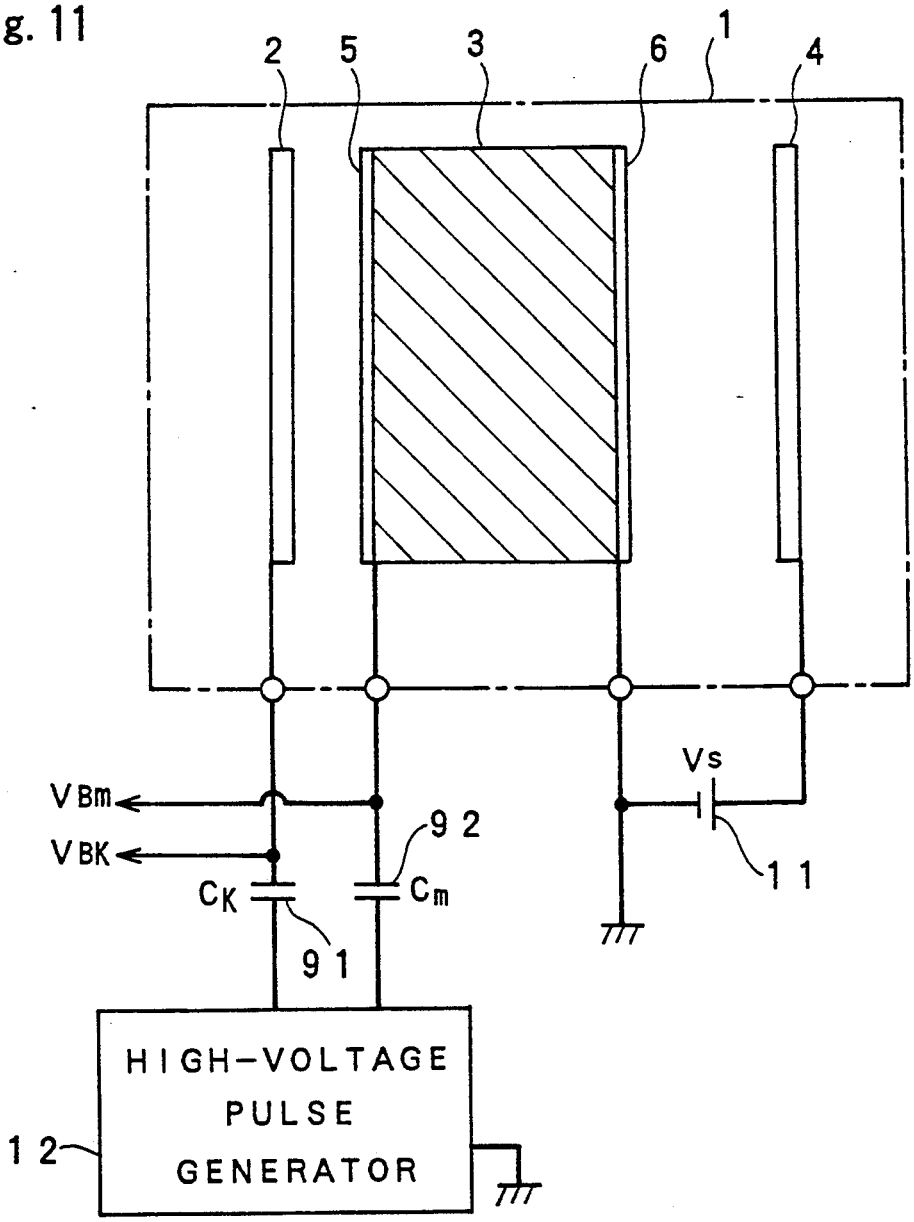
FIGS. 11 and 12 show block diagrams of other embodiments according to the present invention.

FIG. 11 shows an embodiment in which the photocathode 2 and the electron input electrode 5 of the embodiment of FIG. 2 are connected to the high-voltage pulse generator 12 through coupling condensers 91, 92. This is for applying biases $V_{Bk}$, $V_{Bm}$ respectively to the photocathode 2 and the electron input electrode 5. The amplitude of the drive negative pulse voltage from the high-voltage pulse generator 12 can be made small by applying the biases $V_{Bk}$, $V_{Bm}$.

Figure 12:
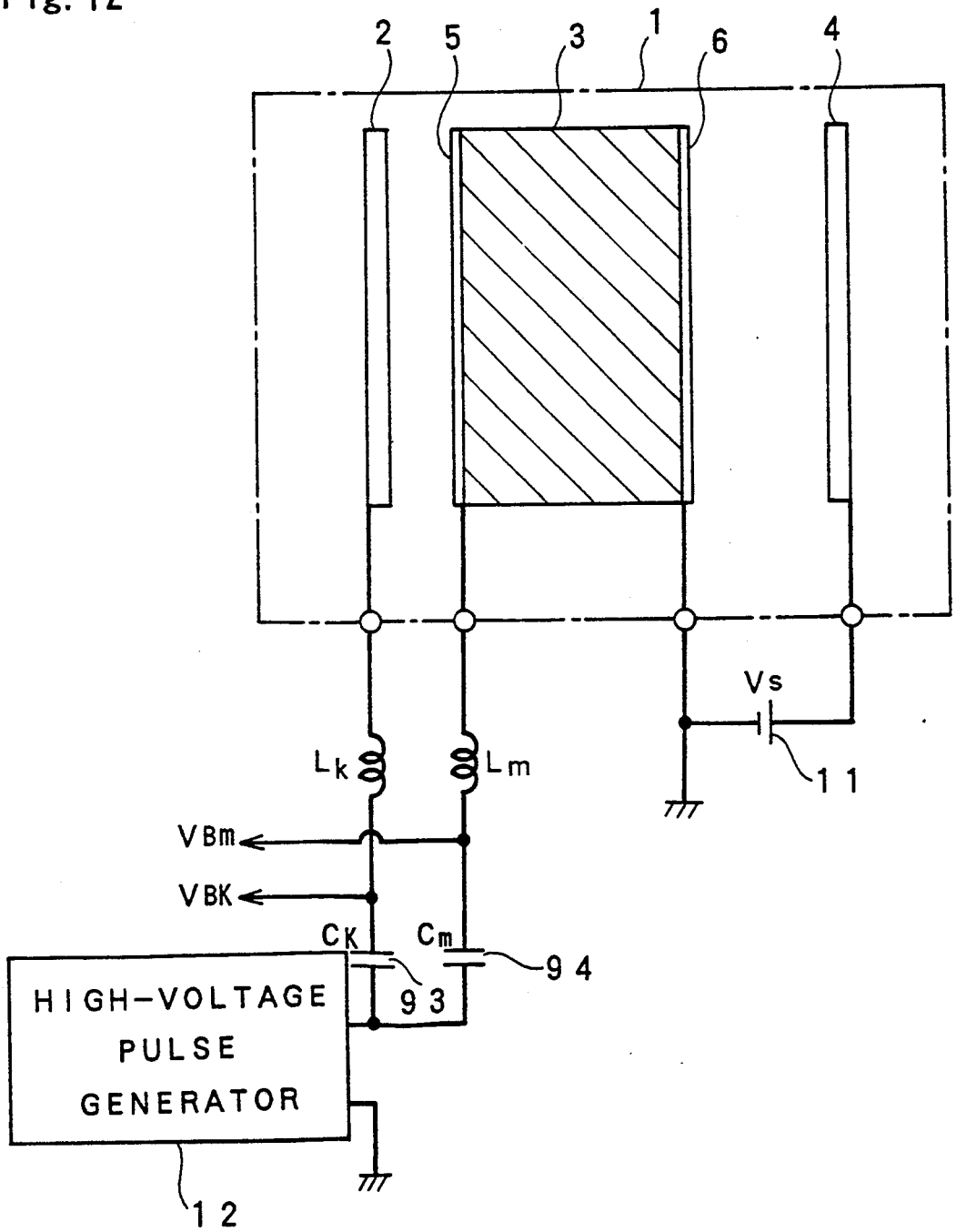

FIG. 12 shows an embodiment in which to the same end, coupling condensers 93, 94 are added to the embodiment of FIG. 9.

In all the above-described embodiments, it is possible to reduce noises by making the potential of the photocathode 2 a little lower (around $-10$s V) between the photocathode 2 and the electron input electrode 5.

All the above-described embodiments are proximity-type image intensifier, but without the phosphor screen 4, all these embodiments operate as photoelectric devices.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

We claim:

1. A method of driving a photoelectric device wherein the photoelectric device includes a photocathode, a micro-channel plate for multiplying electrons emitted from the photocathode and control means for controlling electrons emitted from the photocathode, the method comprising the steps of:

applying a first negative voltage to an electron input electrode of the micro-channel plate, while another electrode of the micro-channel plate is maintained at a reference potential; and applying a second negative voltage which is lower than the first negative voltage to the photocathode at substantially the same time as the application of the first negative voltage to thereby perform an opening of a gate in the photocathode and in the micro-channel plate.

2. A method of driving a photoelectric device according to claim 1, wherein the first negative voltage and the second negative voltage are pulse voltages.

3. A method of driving a photoelectric device according to claim 1 wherein the first negative voltage and the second negative voltage are supplied to the photocathode and the micro-channel plate through a first inductor and a second inductor, the first inductor and the second inductor having different inductances.

4. A method of driving an image intensifier, the image intensifier including a photocathode, a micro-channel plate for multiplying electrons emitted from the photocathode, control means for controlling electrons emitted from the photocathode and a phosphor screen for converting the electrons from the micro-channel plate into visible radiation, said method comprising the steps of:

applying a first negative voltage to an input surface of the micro-channel plate, while an electrode of the respect to the reference potential to the phosphor screen; and applying a second negative voltage which is lower than the first negative voltage to the photocathode at substantially the same time as the application of the first negative voltage to thereby perform an opening of a gate in the photocathode and in the micro-channel plate.

* * * * *

UNITED STATES PATENT AND TRADEMARK OFFICE

CERTIFICATE OF CORRECTION

PATENT NO. : 5,204,522

DATED : April 20, 1993

INVENTOR(S) : Akira TAKAHASHI et al.

It is certified that error appears in the above-identified patent and that said Letters Patent is hereby corrected as shown below:

In claim 4, column 6, line 31, after "of the", insert --micro-channel plate is maintained at a reference potential;
applying a positive direct current voltage with--.

Signed and Sealed this

First Day of November, 1994

*Attest:*

*Attesting Officer*

BRUCE LEHMAN

*Commissioner of Patents and Trademarks*